US007641457B2

(12) United States Patent
Asai et al.

(10) Patent No.: US 7,641,457 B2
(45) Date of Patent: Jan. 5, 2010

(54) INTERNAL GEAR PUMP

(75) Inventors: Yasuo Asai, Kashiwara (JP); Takatoshi Sakata, Yamatotakada (JP); Ikuo Yamamoto, Kashiwara (JP)

(73) Assignee: JTEKT Corporation, Osaka-shi, Osaka (JP)

( * ) Notice: Subject to any disclaimer, the term of this patent is extended or adjusted under 35 U.S.C. 154(b) by 3 days.

(21) Appl. No.: 11/727,561

(22) Filed: Mar. 27, 2007

(65) Prior Publication Data

US 2007/0231176 A1 Oct. 4, 2007

(30) Foreign Application Priority Data

Mar. 28, 2006 (JP) ..... P2006-087112
Mar. 28, 2006 (JP) ..... P2006-087113

(51) Int. Cl.
*F04C 18/00* (2006.01)
*F04C 2/00* (2006.01)

(52) U.S. Cl. ..... 418/171; 417/356; 417/410.1; 417/410.4; 310/261; 310/40 R

(58) Field of Classification Search ..... 418/131, 418/132, 166, 171, 142; 417/410.1, 410.3, 417/410.4, 372, 356; 310/10, 40 R, 261
See application file for complete search history.

(56) References Cited

U.S. PATENT DOCUMENTS

| | | | | |
|---|---|---|---|---|
| 1,486,836 | A | | 3/1924 | Hill |
| 2,871,793 | A | | 2/1959 | Michie et al. |
| 3,008,061 | A | * | 11/1961 | Mims et al. ..... 310/83 |
| 3,679,334 | A | | 7/1972 | Keldrauk |

FOREIGN PATENT DOCUMENTS

| | | | |
|---|---|---|---|
| DE | 14 03 923 | A1 | 11/1969 |
| DE | 27 17 824 | | 11/1977 |
| EP | 1 526 282 | A | 4/2005 |
| GB | 370474 | | 4/1932 |
| JP | 4-91382 | | 3/1992 |
| JP | 2001-193667 | | 7/2001 |
| JP | 2003-129966 | | 5/2003 |
| JP | 2003-286969 | | 10/2003 |
| JP | 2004108351 | A * | 4/2004 |
| JP | 2004-278444 | | 10/2004 |
| JP | 2006-63950 | | 3/2006 |
| JP | 2006274927 | A * | 10/2006 |

OTHER PUBLICATIONS

European Search Report dated Nov. 22, 2007.
European Search Report Dated Aug. 7, 2007.

* cited by examiner

*Primary Examiner*—Theresa Trieu
(74) *Attorney, Agent, or Firm*—McGinn Intellectual Property Law Group, PLLC

(57) ABSTRACT

The invention relates to an internal gear pump including: a rotor member including an outer rotor provided with inner teeth to which a torque supplied from a driving device is transmittable; an inner rotor provided with outer teeth engageable with the inner teeth of the outer rotor so to be driven by a rotation of the outer rotor, wherein a rotation axis of the inner rotor is eccentric with respect to a center of the rotor member; a pair of housings provided on opposite sides of the rotor member and the inner rotor to support the rotor member and the inner rotor; and at least one rolling bearing provided between at least one of the housings and the rotor member.

7 Claims, 9 Drawing Sheets

INTERNAL GEAR PUMP

BACKGROUND OF THE INVENTION

1. Field of the Invention

The present invention relates to an internal gear pump used as a lubricating oil pump for an engine or an electric pump for pumping hydraulic fluid in a transmission in an automobile.

2. Related Art

Conventionally, an internal gear pump such as a trochoid pump has been used as a pump, which pumps lubricating oil for an engine in an automobile. The internal gear pump includes an inner rotor that includes outer teeth, an outer rotor that includes inner teeth engaged with the outer teeth, pump housings within which the inner and outer rotors are received, a driving shaft that is attached to the inner rotor so as to be integrally rotatable therewith and protrudes from the pump housings to the outside, and a sprocket attached to a projection portion of the driving shaft which protrudes from the housings to the outside so as to be integrally rotatable therewith to transmit torque from the engine. The internal gear pump having the above-mentioned structure is configured such that the inner rotor is rotated when the driving shaft is driven by torque transmitted from the engine to the sprocket (for example, see JP-A-2003-286969).

In the internal gear pump in the above-mentioned related art, the driving shaft is driven by torque transmitted to the sprocket so that the inner rotor is rotated. However, the pump housings for receiving the inner and outer rotors therein and the sprockets for driving the inner rotor are juxtaposed in an axial direction. Therefore, there has been a problem in that the size of the internal gear pump in the axial direction thereof is relatively large.

On the other hand, the internal gear pump has been also used for as a pump for hydraulic fluid in a transmission in an automobile. In the transmission, the internal gear pump is mounted as an electric gear pump in which the internal gear pump is incorporated with an electric motor to drive the internal gear pump. Conventionally, such an electric gear pump includes an inner rotor that includes outer teeth and an outer rotor that includes inner teeth engaged with the outer teeth. One of the outer rotor and the inner rotor is driven to be rotated by the motor.

In the electric gear pump in such related art, since a pump part including inner and outer rotors and a motor for driving the pump part are usually juxtaposed in an axial direction, there have been many cases where the size of the electric gear pump is relatively large in the axial direction.

There has been a pump in another related art where an outer rotor to be driven is incorporated in a motor rotor and a gear pump is disposed within a motor so that the size of the pump in an axial direction is reduced (for example, see JP-A-2003-129966).

In the motor rotor in the above-mentioned related art, a sliding bearing is formed by providing a resin coat on an inner peripheral surface of the motor stator and an outer peripheral surface of the motor rotor, so that the motor rotor is rotatably supported. Since a small clearance is generally formed between the rotating part of the sliding bearing and the stationary part thereof, there is concern that small deviation of rotation axis occurs in the motor rotor, resulting in locking of the motor rotor and the motor stator to each other. When the motor rotor and the motor stator are locked to each other, it is not possible to obtain a stable driving torque and stable pump performance.

Further, according to the sliding bearing used in the related art, peripheral surfaces of the rotating and stationary parts come in contact with each other while the electric gear pump is stopped. Therefore, excessive friction may occur on the sliding bearing at the beginning of the rotation of the motor rotor. In addition, if the rotational speed is not appropriately increased during the rotation, an oil layer is not sufficiently formed between the rotating and stationary parts. For this reason, when the operation and stop of the pump are frequently repeated, there is a problem that abnormal wear may occur on the peripheral surfaces of the rotating and stationary parts due to the operation in addition to the above-mentioned axial deviation of the motor rotor, and the life of the electric gear pump is dramatically shortened.

SUMMARY OF THE INVENTION

The invention has been made to solve the above-mentioned problem, and it is an object of the invention to provide an internal gear pump, which has a reduced size in an axial direction to be made compact. Further, the invention provides an internal gear pump which includes a rotor member provided with an outer rotor and can obtain stable pump performance and maintain high durability while the outer rotor is provided in the rotor member to make the pump compact.

According to an aspect of the invention, there is provided an internal gear pump including:

a rotor member including an outer rotor provided with inner teeth to which a torque supplied from a driving device is transmittable;

an inner rotor provided with outer teeth engageable with the inner teeth of the outer rotor so to be driven by a rotation of the outer rotor, wherein a rotation axis of the inner rotor is eccentric with respect to a center of the rotor member;

a pair of housings provided on opposite sides of the rotor member and the inner rotor to support the rotor member and the inner rotor; and at least one rolling bearing provided between at least one of the housings and the rotor member.

According to the internal gear pump having the above-mentioned structure, since the rotor member provided with the outer rotor is supported by the rolling bearings, the deviation occurring in the rotation axis of the rotor member can be suppressed. Accordingly, it is possible to prevent the locking between the rotor member and the motor stator due to a magnetic force, and to obtain a stable rotation driving force. As a result, it is possible to ensure stable pump performance.

Further, according to the internal gear pump having the above-mentioned structure, the rotor member is supported by the rolling bearings, not by sliding bearings as in the related art. For this reason, even though operation and stop are frequently repeated, serious wear at rotating portions can be prevented and high durability can be obtained.

In the internal gear pump, it is preferable that a through hole is formed in the inner rotor so as to coincide with the rotation axis of the inner rotor; and a shaft is rotatably inserted into the through hole so to protrude from opposite surfaces of the inner rotor, and opposite ends of the shaft are fixed to the housings so that the shaft rotatably supports the inner rotor. In this case, opposite ends of the shaft are fixed to the housings so that the inner rotor is rotatably supported by the shaft.

In this case, for example, compared to the case that the shaft and the inner rotor are formed to be integrally rotatable and rotatably supported by the pair of housings, only inner rotor is rotatably supported with respect to the shaft fixed to the pair of housings. Therefore, it possible to simplify the structure of the internal gear pump and to reduce the manufacturing cost of the internal gear pump.

In the internal gear pump, it is preferable that the shaft includes a pair of sidewalls, which comes in contact with the pair of housings and defines a distance between the pair of housings.

In this case, a predetermined distance is defined between the pair of housings by the pair of sidewalls. Accordingly, clearances between the housings and the inner and outer rotors provided between the pair of housings can be set and maintained to appropriate distances. As a result, it is possible to suppress frictional wear between the housings and the inner and outer rotors, and to prevent liquid which is supplied or discharged by the internal gear pump from leaking from the pump.

According to the invention, the driving device may include a motor stator disposed on an outer peripheral side of the outer rotor to drive the rotor member by electric power. In this case, a magnetic member may be fixed on an outer peripheral surface of the outer rotor to form a motor with the motor stator.

Alternatively, the driving device may include an endless rotation member which is wound around a track formed on an outer peripheral surface of the outer rotor. As the endless rotation member, a belt, roller chain to be engaged with a sprocket, or the like may be employed.

In the invention, a pair of rolling bearings may be provided on opposite sides of the outer rotor and inner rotor to rotatably support the rotor member. Alternatively, one rolling bearing provided on only one of the housings may be sufficient to rotatably support the rotor member.

According to another aspect of the invention, an internal gear pump includes an inner rotor that includes outer teeth, an outer rotor that includes inner teeth engaged with the outer teeth on an inner periphery thereof, and a pair of pump housings that is provided on opposite sides of the outer and inner rotors, such that the outer and inner rotors are rotatably supported by the pump housings. Further, a track on which an endless rotation member for transmitting torque to the outer rotor is wound is formed on an outer periphery of the outer rotor.

According to the internal gear pump having the above-mentioned structure, the endless rotation member is wound on the track formed on the outer periphery of the outer rotor to drive the outer rotor. For this reason, it is possible to allow the position of the endless rotation member to substantially correspond to the positions of the inner and outer rotors in the axial direction. In addition, it is not necessary to juxtapose the sprocket to drive the inner rotor or outer rotor in the pump housings in an axial direction thereof as in the related art. Accordingly, it is possible to reduce the size of the internal gear pump in the axial direction thereof.

The internal gear pump may further include a rolling bearing that is provided between at least one of the pair of pump housings and the outer rotor. The outer rotor is rotatably supported by the rolling bearing.

In this case, it is possible to support a radial load applied to the outer rotor on which the endless rotation member is wound by the rolling bearing. For this reason, even though a tension of the endless rotation member is excessively large, it is possible to endure the tension and to reliably perform the pumping operation by the rotation of the outer rotor and the inner rotor.

Further, the internal gear pump may further include a sliding bearing that is provided between at least one of the pair of pump housings and the outer rotor. The outer rotor may be rotatably supported by the sliding bearing.

In this case, it is possible to simplify the structure in which the outer rotor is supported by the pair of pump housings and to reduce the manufacturing cost of the internal gear pump.

In addition, in the internal gear pump, it is preferable that a through hole is formed in the inner rotor so as to coincide with a rotation axis of the inner rotor, and a shaft is inserted into the through hole and protrudes from opposite surfaces of the inner rotor. Opposite ends of the shaft may be fixed to the pump housings so that the inner rotor is rotatably supported on the shaft.

In this case, only the inner rotor is rotatably supported on the shaft that is fixed to the pair of pump housings, as compared to a case, for example, that the shaft and inner rotor are formed to be integrally rotated and are rotatably supported by the pair of pump housings. Therefore, it possible to simplify the structure of the internal gear pump and to reduce the manufacturing cost of the internal gear pump.

In the internal gear pump, it is preferable that the shaft includes a pair of sidewalls, which comes in contact with the pair of pump housings and defines a distance between the pair of pump housings.

In this case, a predetermined distance is defined between the pair of pump housings by the pair of sidewalls. Accordingly, clearances between the pair of pump housings and the inner and outer rotors provided between the pair of pump housings can be set and maintained to appropriate distances. As a result, it is possible to suppress frictional wear between the pump housings and the inner and outer rotors, and to prevent liquid supplied or discharged by the internal gear pump from leaking from the pump.

According to the internal gear pump of the invention, even though the outer rotor is provided in the rotor member to make the pump compact, it is possible to obtain stable pump performance and maintain high durability.

Further, according to the internal gear pump of the invention, the outer rotor can be driven to be rotated by an endless rotation member. Accordingly, it is possible to reduce the size of the internal gear pump in the axial direction thereof and to make the internal gear pump compact.

DETAILED DESCRIPTION OF THE PREFERRED EMBODIMENTS

Figure 1:
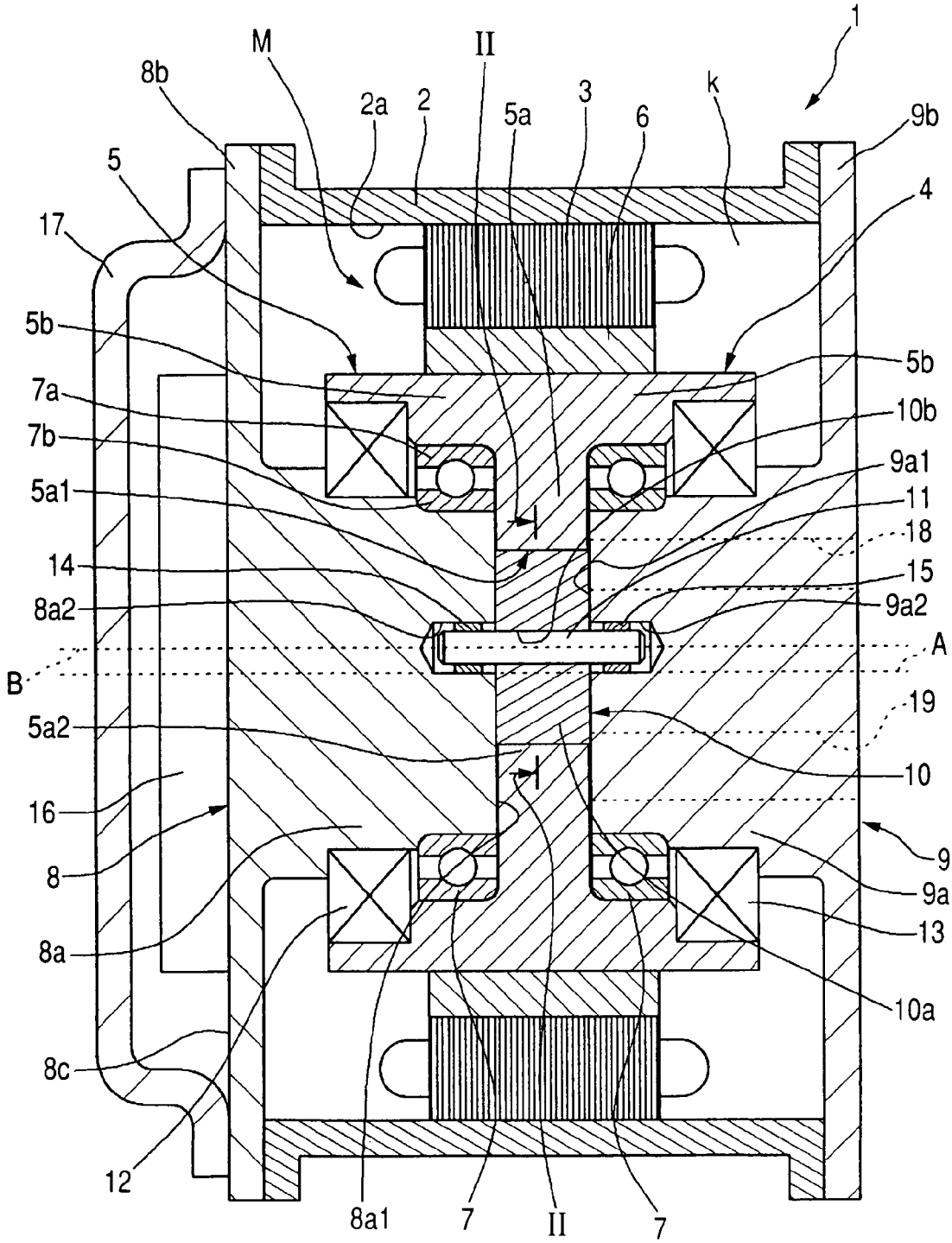
FIG. 1 is a cross-sectional view of an electric gear pump according to a first embodiment of the invention.

Preferred embodiments of the invention will be described hereinafter with reference to accompanying drawings. FIG. 1 is a cross-sectional view of an electric gear pump according to a first embodiment of the invention. The electric gear pump 1 is used as a pump for pumping hydraulic fluid in a transmission in an automobile in which relatively low discharge pressure is required and forms a trochoid pump that is a kind of the internal gear pump.

The electric gear pump 1 includes a motor stator 3 and a motor rotor 4, which are received in a cylindrical case 2 and form a motor M. The motor rotor 4 constitutes a rotor member in this embodiment. An outer rotor 5 is incorporated in the motor rotor 4 so as to form an internal gear pump together with an inner rotor 10 to be described below. The motor rotor 4 forms an internal gear pump in the motor M.

The motor stator 3 has the structure in which a copper wire is wound on a core formed of laminated electromagnetic steel sheets, and is fixed to an inner peripheral surface 2*a* of the case 2. The motor rotor 4 is provided on the inner periphery of the motor stator 3 so as to face the motor rotor 4 with a small clearance therebetween.

The motor rotor 4 includes an outer rotor 5 that has a substantially cylindrical shape, and a cylindrical magnet 6 that is fixed to an outer peripheral surface of the outer rotor 5 so as to face the motor stator 3.

Figure 2:
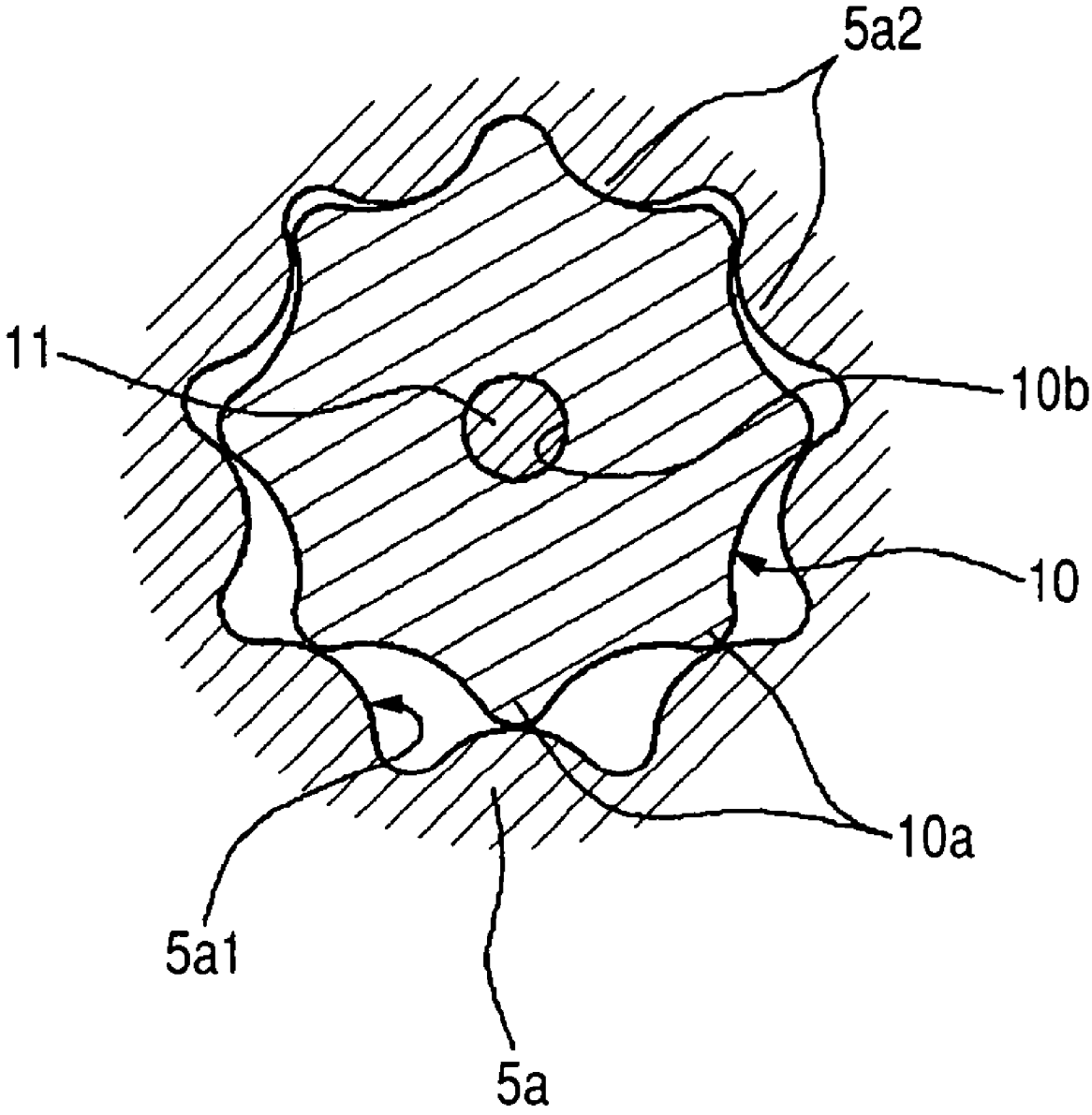
FIG. 2 is a cross-sectional view taken along a line II-II shown in FIG. 1.

FIG. 2 is a cross-sectional view taken along a line II-II shown in FIG. 1. As shown in FIGS. 1 and 2, the outer rotor 5 includes a rotor part 5*a* which has an inner surface 5*a*1 from which inner teeth 5*a*2 protrude inward and a pair of cylindrical parts 5*b* which extends from opposite edges of the rotor part 5*a* in an axial direction. A pair of ball bearings 7 is provided between the inner peripheral surfaces of the cylindrical parts 5*b* and first and second housings 8 and 9 to be described below. The motor rotor 4 is rotatably supported with respect to the first and second housings 8 and 9.

In addition, the inner rotor 10, which includes outer teeth 10*a* engaged with the inner teeth 5*a*2, is provided on a side of the inner surface 5*a*1 of the outer rotor 5. The inner rotor 10 includes a through hole 10*b* coincided with a rotation axis thereof. A shaft 11 is press-fitted into the through hole 10*b* such that opposite ends of the shaft 11 protrude from the inner rotor 10 and that the inner rotor 10 and the shaft 11 are integrally rotatable.

The first and second housings 8 and 9 are provided on opposite sides of the motor rotor 4 and inner rotor 10 so as to sandwich and support the motor rotor 4 and the inner rotor 10 therebetween. The housings 8 and 9 are made of, for example, an aluminum alloy. Further, the housings 8 and 9 include substantially cylindrical supporting parts 8*a* and 9*a* which support the motor rotor 4 and the inner rotor 10 and flange parts 8*b* and 9*b* which extend radially outwardly from outer edges of the supporting parts 8*a* and 9*a* on outer portions thereof in the axial direction. The case 2 is interposed between the outer peripheral edges of the flange parts 8*b* and 9*b*, and opposite ends of the case 2 are connected to the outer ends of the flange parts 8*b* and 9*b*. The case 2 and the housings 8 and 9 are connected to each other as described above to form a space K in which the motor stator 3 and the motor rotor 4 are received.

The pair of ball bearings 7 is fitted around the outer peripheral surfaces of the supporting parts 8*a* and 9*a* of the housings 8 and 9 as described above. The outer rings 7*a* of the ball bearings 7 are fitted onto inner peripheral surfaces of the cylindrical parts 5*b* of the outer rotor 5, and the inner rings 7*b* thereof are fitted around outer peripheral surfaces of the supporting parts 8*a* and 9*a*, such that the motor rotor 4 is supported to be rotated about an axis A of the supporting parts 8*a* and 9*a*. The pair of ball bearings 7 comes in contact with the side surfaces of the rotor part 5*a* of the outer rotor 5 so as to sandwich the rotor part 5*a* therebetween. Accordingly, a distance between the pair of ball bearings 7 is defined in the axial direction. Seal members 12 and 13, which seal clearances between the cylindrical parts 5*b* and the outer peripheral surfaces of the supporting parts 8*a* and 9*a*, are provided on the outside of the ball bearings 7 in the axial direction.

Further, holes 8*a*2 and 9*a*2 into which the shaft 11 press-fitted into the inner rotor 10 is inserted are formed on the inner surface 8*a*1 of the supporting part 8*a* and the inner surface 9*a*1 of the supporting part 9*a* so that the center of the holes 8*a*2 and 9*a*2 coincides with an axis B located above the axis A. Bushes 14 and 15 are press-fitted onto inner peripheral surfaces of the holes the holes 8*a*2 and 9*a*2 to form sliding bearings interposed between the outer peripheral surface of the shaft 11 and the inner peripheral surfaces of the holes 8*a*2 and 9*a*2. Accordingly, the inner rotor 10 is rotatably supported with respect to the housings 8 and 9.

A controller 16 for controlling electric power supplied to the motor stator 3 is provided on an outer surface 8*c* of the first housing 8, and a cover member 17 for covering the controller 16 is fixed to the outer surface 8*c* of the first housing 8.

According to the electric gear pump 1 having the above-mentioned structure, when electric power is supplied to the motor stator 3 by the controller 16, the motor rotor 4 forming the motor M together with the motor stator 3 is rotated about the axis A. When the motor rotor 4 is rotated, the outer rotor 5 is also rotated integrally with the motor rotor 4. When the outer rotor 5 is rotated by the rotation of the motor rotor 4, the inner rotor 10, which includes the outer teeth 10*a* engaged with the inner teeth 5*a*2 of the outer rotor 5, is driven to be rotated about the axis B. That is, the inner rotor 10 is driven to be rotate so as to be eccentric with respect to the axis A as the rotation center of the outer rotor 5. In this process, a pumping effect occurs due to the volumetric change of spaces, which is formed by the outer teeth 10*a* and the inner teeth 5*a*2. Further, an inlet 18 which communicates the inner surface 9*a*1 and the outside to supply hydraulic fluid therethrough and an outlet 19 which communicates the inner surface 9*a*1 and the outside to discharge hydraulic fluid therethrough are formed in the supporting part 9*a* of the second housing 9.

Further, by providing the outer rotor 5 to be driven in the motor rotor 4 as described above, it is possible to further reduce the size of the electric gear pump 1 in the axial direction thereof and to make the electric gear pump 1 more compact, as compared to when an internal gear pump and a motor for driving the internal gear pump (electric gear pump) are juxtaposed.

According to the electric gear pump 1, which has the above-mentioned structure, of this embodiment, since the motor rotor 4 including the outer rotor 5 is supported by the ball bearings 7, it is possible to suppress the axial deviation occurring in the rotation axis of the motor rotor 4. Accordingly, it is possible to prevent the locking between the motor rotor 4 and the motor stator 3 due to a magnetic force, and to obtain stable a rotation driving force. As a result, it is possible to ensure stable pump performance. Further, the motor rotor 4 is supported by the ball bearings 7, not by sliding bearings in the related art. Therefore, even though operation and stop of the pump are frequently repeated, it is possible to prevent wear at rotating portions of the motor rotor 4 and to obtain high durability.

According to the electric gear pump 1 of this embodiment, even though the outer rotor 5 is provided in the motor rotor 4 to make the electric gear pump 1 compact, it is still possible to obtain stable pump performance and high durability.

Figure 3:
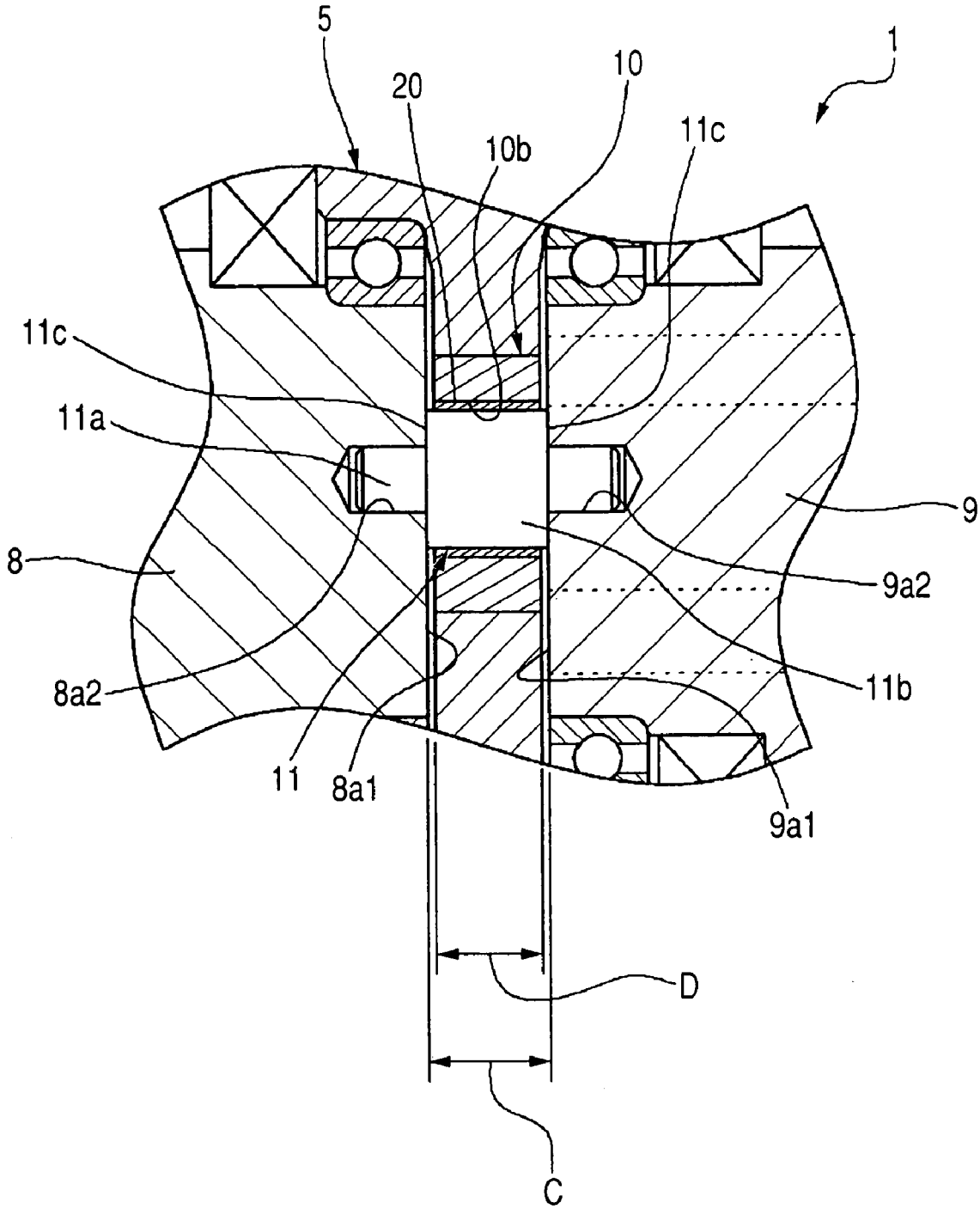
FIG. 3 is a cross-sectional view partially showing an electric gear pump 1 according to a second embodiment of the invention.

FIG. 3 is a cross-sectional view partially showing an electric gear pump 1 according to a second embodiment of the invention. Major differences between this embodiment and the first embodiment are as follows: A shaft 11 is press-fitted to housings 8 and 9 and the inner rotor 10 is rotatable with respect to the shaft 11; and, a pair of sidewalls which comes in contact with the housings 8 and 9 to define a distance between the housings 8 and 9 in an axial direction thereof is formed on the outer peripheral surface of the shaft 11. Since the second embodiment is the same as the first embodiment except for these differences, the descriptions thereof will be omitted. In addition, for the understanding of the drawing, distances between the rotor part 5*a* and inner rotor 10 and the housings 8 and 9 are exaggerated in FIG. 3.

In FIG. 3, the shaft 11 includes small-diameter parts 11*a* that are formed on opposite ends of the shaft 11 and press-fitted to holes 8*a*2 and 9*a*2 of the housings 8 and 9, and a large-diameter part 11*b* that has a diameter larger than the diameter of the small-diameter part 11*a* and supports the inner rotor 10. A pair of sidewalls 11*c*, which is parallel to a plane perpendicular to the axial direction and faces the outsides in the axial direction, is formed between the small-diameter parts 11*a* and the large-diameter part 11*b* on opposite sides of the large-diameter part 11*b*.

Further, a cylindrical bush 20, which forms a sliding bearing together with the outer peripheral surface of the large-diameter part 11*b* of the shaft 11, is press-fitted onto the inner peripheral surface of a through hole 10*b* of the inner rotor 10. Accordingly, the inner rotor 10 is rotatably supported with respect to the shaft 11.

That is, the shaft 11 is inserted into the through hole 10*b* through the bush 20 such that the small-diameter parts 11*a* protrude from opposite side surfaces of the inner rotor 10. Further, the small-diameter parts 11*a* are press-fitted to the holes 8*a*2 and 9*a*2 of the housings 8 and 9 so that the inner rotor 10 is rotatably supported.

In contrast, for example, in a case that the shaft 11 and the inner rotor 10 are formed to be integrally rotatable, the inner rotor 10 and the shaft 11 are rotatably supported with respect to the housings 8 and 9. Accordingly, it is necessary to provide sliding bearings such as bushes at two locations on opposite ends of the shaft 11.

On the other hand, according to this embodiment, only the inner rotor 10 is rotatably supported with respect to the shaft 11 press-fitted to the housings 8 and 9. Therefore, one bush 20 forming a sliding bearing can be provided at only one location to the inner rotor 10. As a result, it is possible to simplify the structure and to reduce manufacturing cost.

In addition, the sidewalls 11*c* of the shaft 11 come in contact with the inner surfaces 8*a*1 and 9*a*1 of the housings 8 and 9, and the shaft 11 is interposed between the housings 8 and 9. Since the large-diameter part 11*b* of the shaft 11 is interposed between the housings 8 and 9 so as to come in contact with the sidewalls 11*c* as described above, a predetermined distance is defined between the housings 8 and 9. Meanwhile, for example, a distance C between the housings 8 and 9 is set to be 20 to 100 μm larger than the thickness D of the rotor part 5*a* and the inner rotor 10 in the axial direction, so that a clearance of about 10 to 50 μm can be ensured on opposite sides of the rotor part 5*a* and the inner rotor 10.

According to this embodiment, the predetermined distance is defined between the housings 8 and 9 by the sidewalls 11*c* formed on the shaft 11 as described above. By this construction, clearances between the housings 8 and 9 and the inner rotor 10 and the rotor part 5*a*, which are provided between the housings 8 and 9, can be set and maintained to appropriate distances. As a result, it is possible to suppress frictional wear between the housings 8 and 9 and the inner rotor 10 and rotor part 5*a*, and to prevent lubricating oil which is supplied or discharged by the electric gear pump 1 from leaking from the pump.

Figure 4:
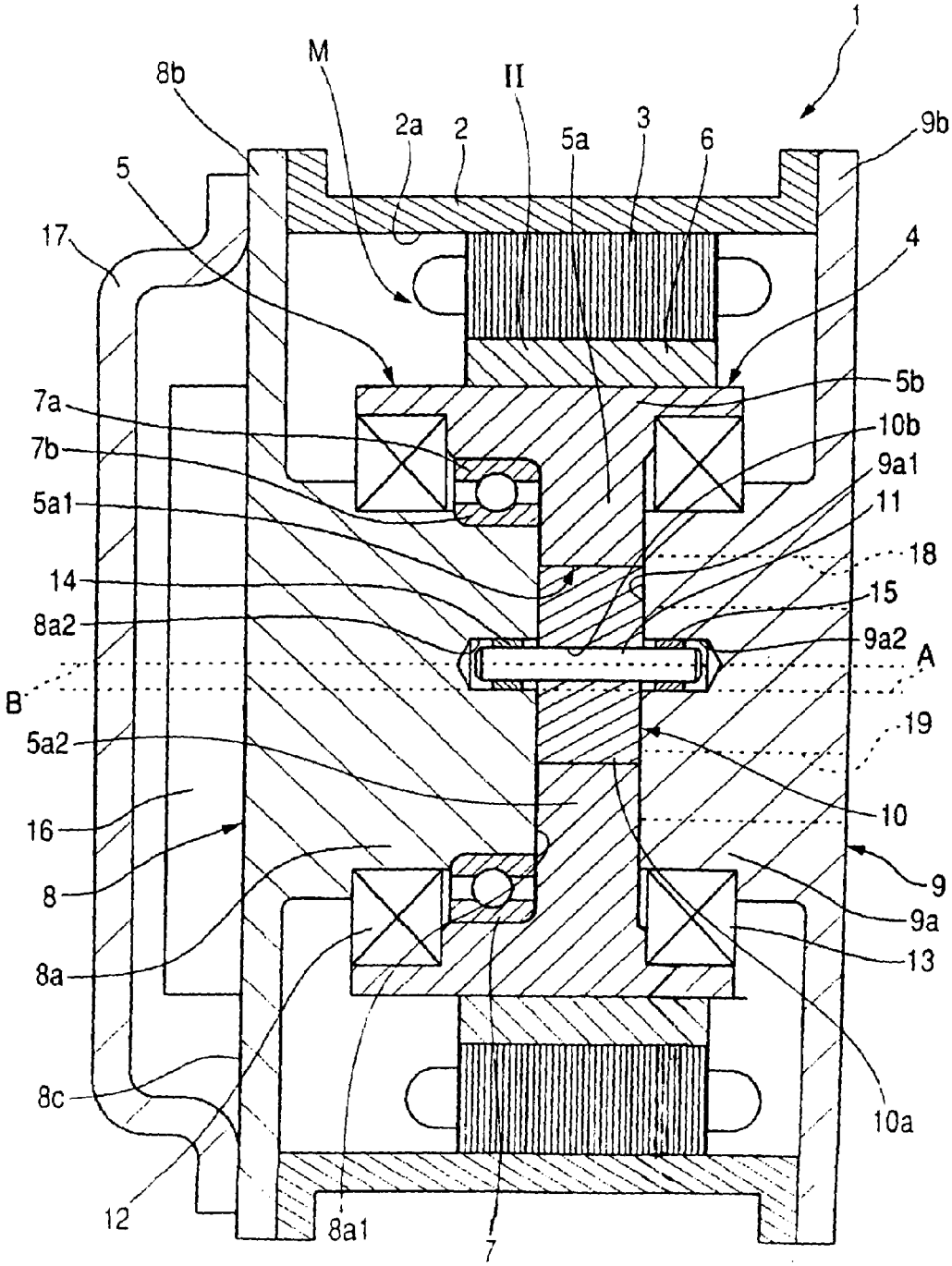
FIG. 4 is a cross-sectional view partially showing an electric gear pump 1 according to a third embodiment of the invention.

FIG. 4 is a cross-sectional view showing an electric gear pump 1 according to a third embodiment of the invention. Major differences between this embodiment and the first embodiment are as follows: No bearing is interposed between the second housing 9 in which the inlet 18 and the outlet 19 are formed and the outer rotor 5, and only the seal member 13 is interposed therebetween. Since the third embodiment is the same as the first embodiment except for these differences, the descriptions thereof will be omitted. In addition, for the understanding of the drawing, distances between the rotor part 5*a* and inner rotor 10 and the housings 8 and 9 are exaggerated in FIG. 3.

As shown in FIG. 4, the ball bearing 7 is disposed only at one location between the first housing 8 and the outer rotor 5. According to this structure, it is not necessary to define a distance in the axial direction to dispose a bearing on the outer peripheral surface of the support part 9*a* of the second housing 9 as well as on the cylindrical part 5*b* in the outer rotor 5 located on the side of the second housing 9. Therefore, it is possible to further reduce the size of the electric gear pump 1 in the axial direction thereof and to make the electric gear pump 1 more compact, as compared to the first embodiment. In addition, passage lengths of the inlet 18 and the outlet 19 can be made smaller, such that supply or discharge of the fluid in the electric gear pump 1 can be conducted more smoothly and easily for various applications.

Further, only one ball bearing 7 is provided in the electric gear pump 1. Therefore, number of parts can be reduced as compared to the first embodiment. As a result, it is possible to simplify the structure and to reduce manufacturing cost.

Further, although the motor rotor 4 has been supported by the ball bearings 7 in the above embodiments, other rolling bearings, such as roller bearings and tapered roller bearings, may be applied to the invention. In addition, although the motor rotor 4 has been supported by the pair of ball bearings 7 in the embodiments, one side of the motor rotor may be supported by a ball bearing 7 and the other side thereof may be supported by a sliding bearing.

Figure 5:
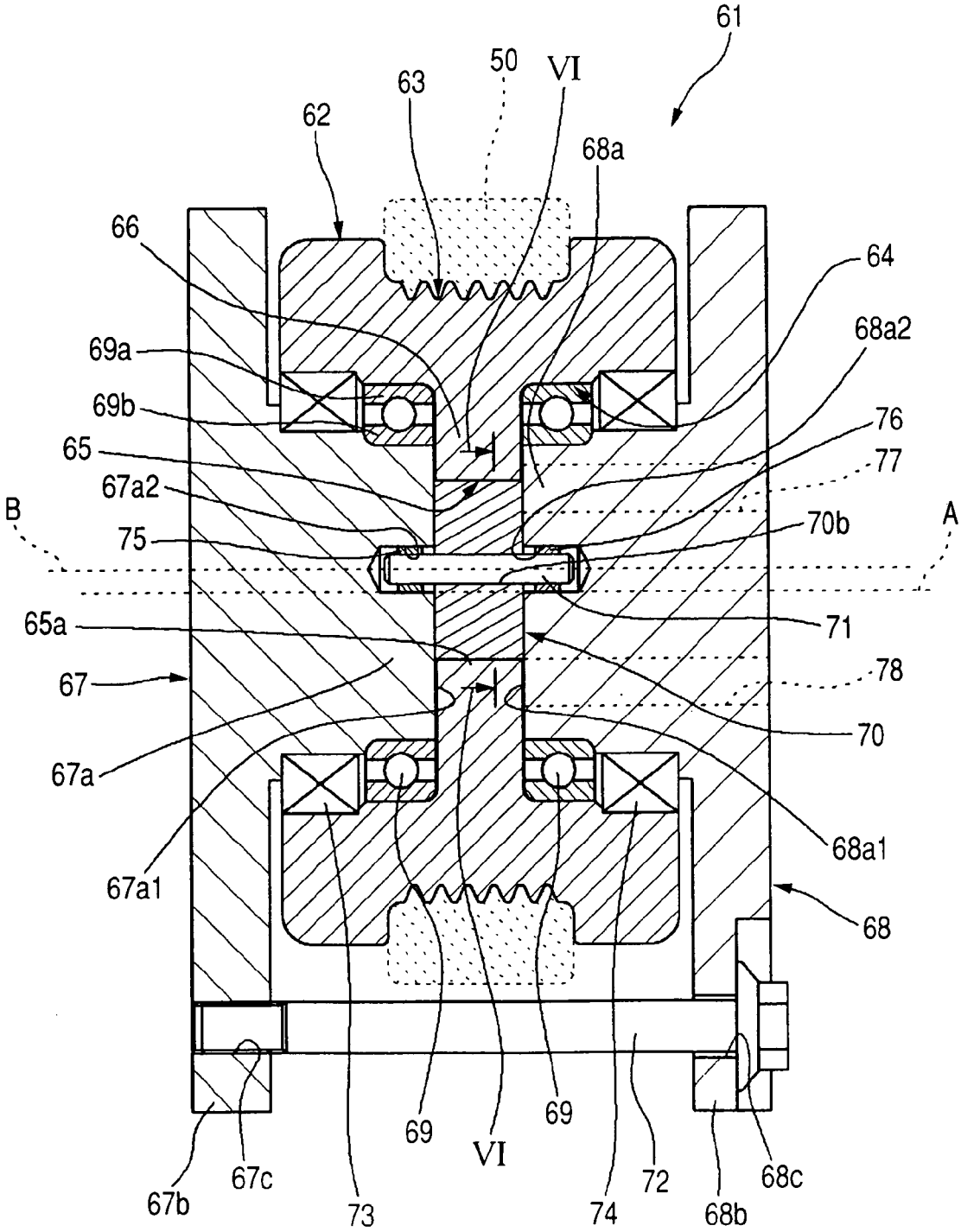
FIG. 5 is a cross-sectional view of an internal gear pump according to a fourth embodiment of the invention.
Figure 6:
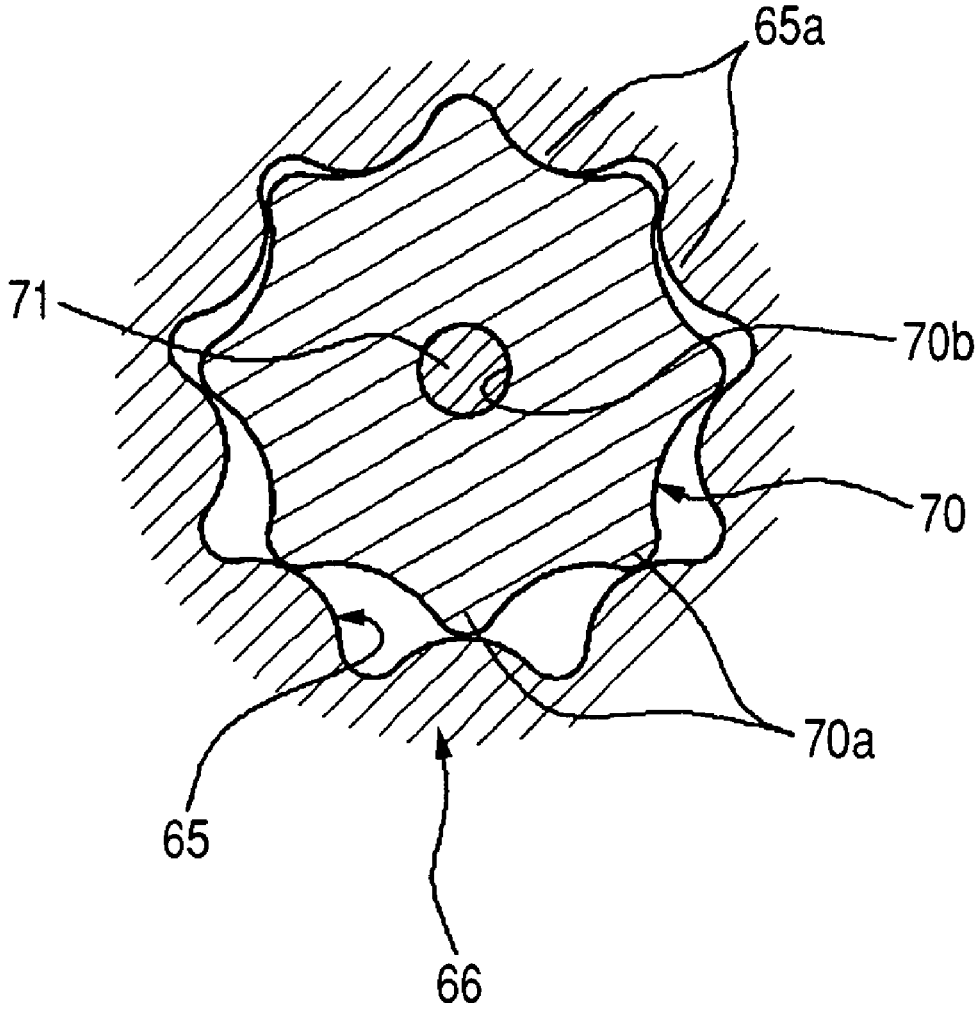
FIG. 6 is a cross-sectional view taken along a line VI-VI shown in FIG. 5.

Fourth embodiment of the invention will be described hereinafter with reference to accompanying drawings. FIG. 5 is a cross-sectional view of an internal gear pump according to a fourth embodiment of the invention, and FIG. 6 is a cross-sectional view taken along a line VI-VI shown in FIG. 5. The internal gear pump 61 is used as a pump for pumping lubricating oil in an engine of an automobile, and forms a trochoid pump that is a kind of an internal gear pump.

The internal gear pump 61 includes an outer rotor 62, which has a substantially cylindrical shape. The outer rotor constitutes a rotor member in this embodiment. A wavy groove 63 used as a track on which a belt 50 used as an endless rotation member for transmitting torque from an engine (not shown) is wound is formed on the outer peripheral surface of the outer rotor 62. A rotor part 66 including an inner surface 65, from which inner teeth 65*a* protrude inward, is formed on the inner peripheral surface 64 of the outer rotor 62.

Further, a pair of ball bearings 69 is provided between the inner peripheral surface 64 of the outer rotor 62 and first and second pump housings 67 and 68 to be described below. The outer rotor 62 is rotatably supported with respect to the first and second pump housings 67 and 68.

An inner rotor 70, which includes outer teeth 70*a* engaged with the inner teeth 65*a*, is provided on a side of the inner surface 65 of the rotor part 66. The inner rotor 70 includes a through hole 70*b* coincided with a rotation axis thereof. A shaft 71 is press-fitted into the through hole 70*b* such that the shaft 71 protrudes from opposite surfaces of the inner rotor 70 and is integrally rotatable therewith. The shaft protrudes from opposite surfaces of the inner rotor 70.

The first and second pump housings 67 and 68 are provided on opposite sides of the rotor part 66 and inner rotor 70 so as to sandwich and support the rotor part 66 and inner rotor 70 therebetween. The pump housings 67 and 68 are made of, for example, an aluminum alloy. Further, the pump housings 67 and 68 include substantially cylindrical supporting parts 67*a* and 68*a* which support the outer rotor 62 and the inner rotor 70 and flange parts 67*b* and 68*b* which extend radially outwardly from outer edges of the supporting parts 67*a* and 68*a* at outer side portions in the axial direction. Holes 67*c* and 68*c* are formed at the outer edges of the flange parts 67*b* and 68*b*. Internal threads are formed on the inner peripheral surface of the hole 67*c*, and a bolt 72 inserted into the hole 68*c* is screwed on the internal threads. By coupling the flange parts 67*b* and 68*b* to each other by the bolt 72, movement of the pump housings 67 and 68 in the axial direction is blocked. Further, the outer rotor 62 and the inner rotor 70 are reliably supported by the pump housings 67 and 68.

The pair of ball bearings 69 is fitted around the outer peripheral surfaces of the supporting parts 67*a* and 68*a* of the pump housings 67 and 68 as described above. The outer races 69*a* of the ball bearings 69 are fitted onto the inner peripheral surface 64 of the outer rotor 62, and the inner races 69*b* thereof are fitted around the outer peripheral surfaces of the supporting parts 67*a* and 68*a*. Further, the outer rotor 62 is supported to be rotated about an axis A of the supporting parts 67*a* and 68*a*.

The pair of ball bearings 69 comes in contact with the side surfaces of the rotor part 66 so that the rotor part is interposed between the ball bearings. Accordingly, a distance between the pair of ball bearings 69 is defined in the axial direction. Seal members 73 and 74, which seal clearances between the inner peripheral surfaces 64 of the outer rotor 62 and the outer peripheral surfaces of the supporting parts 67*a* and 68*a*, are provided on outer sides of the ball bearings 69 in the axial direction.

Further, holes 67*a*2 and 68*a*2, into which the shaft 71 press-fitted into the inner rotor 70 is inserted, are formed on the inner surface 67*a*1 of the supporting part 67*a* and the inner surface 68*a*1 of the supporting part 68*a*, respectively, so as to have an axis B as the center of the holes that is located above the axis A. Bushes 75 and 76, which are interposed between the outer peripheral surface of the shaft 71 and the inner peripheral surfaces of the holes 67*a*2 and 68*a*2 to form sliding bearings, are press-fitted onto the inner peripheral surfaces of the holes 67*a*2 and 68*a*2. Accordingly, the inner rotor 70 is rotatably supported with respect to the pump housings 67 and 68.

When torque is transmitted from an engine to the internal gear pump 61 having the above-mentioned structure by the belt 50, the outer rotor 62 is rotated about the axis A. When the outer rotor 62 is rotated, the inner rotor 70, which includes the outer teeth 70*a* engaged with the inner teeth 65*a* of the rotor part 66 of the outer rotor 62, is driven to be rotated about the axis B. That is, while being eccentric with respect to the axis A used as the rotation center of the outer rotor 62, the inner rotor 70 is driven to be rotated. In this process, a pumping operation occurs due to the volumetric change of spaces, which are formed by the outer teeth 70*a* and the inner teeth 65*a*. Further, an inlet 77 which communicates the inner surface 68*a*1 and the outside to supply lubricating oil therethrough and an outlet 78 which communicates the inner surface 68*a*1 and the outside to discharge lubricating oil therethrough are formed in the supporting part 68*a* of the second pump housing 68. The internal gear pump 61 can pump lubricating oil by the pumping effect of the outer rotor 62 and the inner rotor 70.

According to the internal gear pump 61 of this embodiment, which has the above-mentioned structure, of this embodiment, the belt 50 is wound on the wavy groove 63 formed on the periphery of the outer rotor 62 so that the outer rotor 62 is driven to be rotated. For this reason, it is possible to allow the position of the belt 50 to substantially correspond to the positions of the inner and outer rotors 62 and 70 in the axial direction. In addition, it is not necessary to juxtapose the sprocket to drive the inner rotor 70 or outer rotor 62 in the pump housings 67 and 68 in an axial direction thereof as in the related art. Accordingly, it is possible to reduce the size of the internal gear pump 61 in the axial direction thereof and to make the internal gear pump compact.

Further, according to this embodiment, the outer rotor 62 is rotatably supported by the pair of ball bearings 69, which is provided between the pump housings 67 and 68. For this reason, it is possible to support a radial load applied to the outer rotor 62, on which the belt 50 is wound, by the pair of ball bearings 69. Further, even though a tension of the belt 50 is excessively large, it is possible to endure the tension and to reliably perform the pumping operation by the rotation of the outer rotor 62 and the inner rotor 70.

Figure 7:
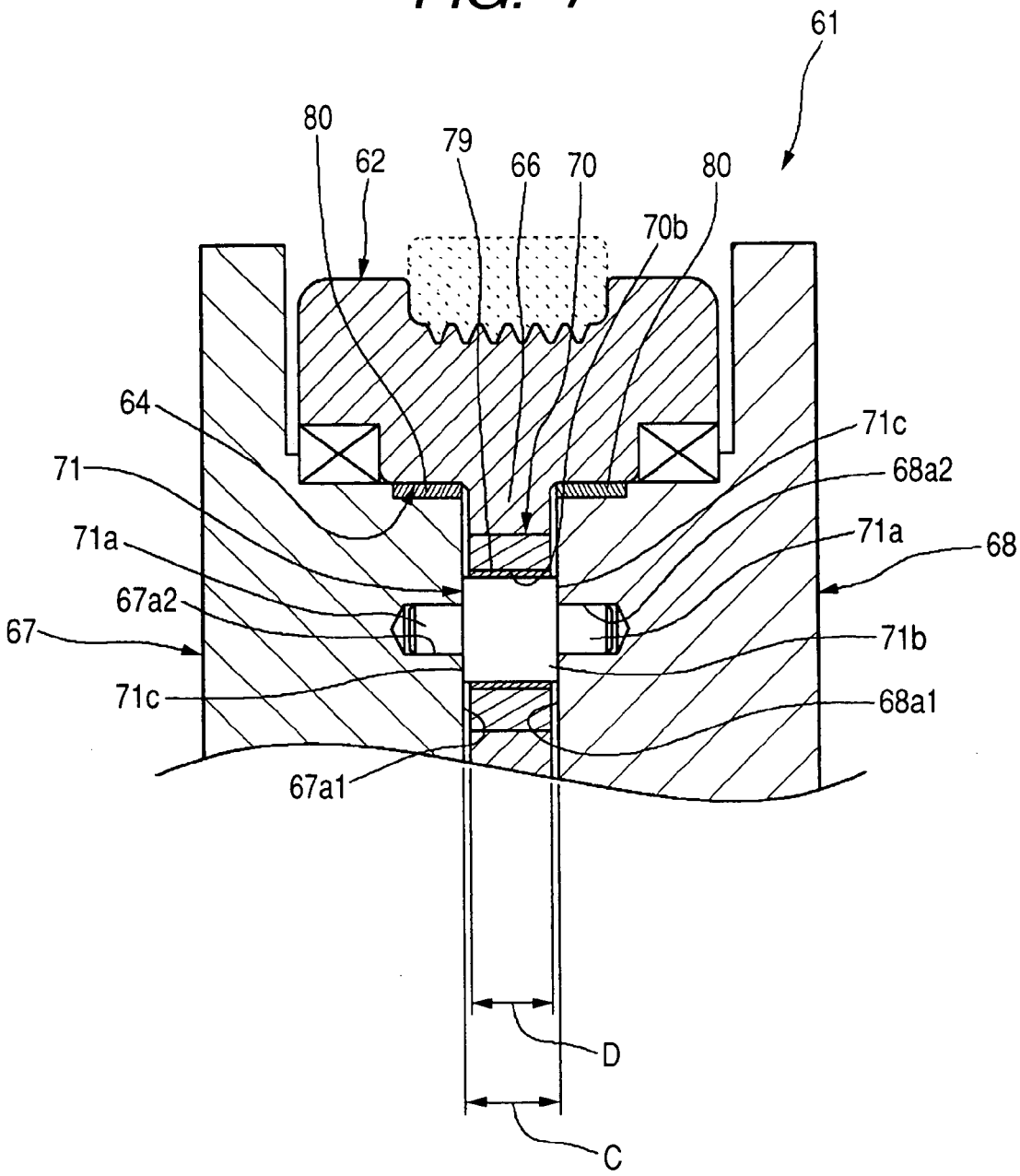
FIG. 7 is a cross-sectional view partially showing an internal gear pump 61 according to a fifth embodiment of the invention.

FIG. 7 is a cross-sectional view partially showing an internal gear pump 61 according to a fifth embodiment of the invention. Major differences between this embodiment and the first embodiment are as follows: A shaft 71 is press-fitted to pump housings 67 and 68 such that the inner rotor 70 is rotatable with respect to the shaft 71; a pair of sidewalls, which comes in contact with the pump housings 67 and 68 to define a distance between the pump housings 67 and 68 in an axial direction thereof, is formed on the outer peripheral surface of the shaft 71; and, the outer rotor 62 is supported by sliding bearings to be rotated relative to the pump housings 67 and 68. Since the second embodiment is the same as the first embodiment except for these differences, the descriptions thereof will be omitted. In addition, for the understanding of the drawing, distances between the rotor part 66 and inner rotor 70 and the pump housings 67 and 68 are exaggerated in FIG. 7.

In FIG. 7, the shaft 71 includes small-diameter parts 71*a* that are formed on opposite ends thereof and press-fitted to holes 67*a*2 and 68*a*2 of the pump housings 67 and 68, and a large-diameter part 71*b* that has a diameter larger than the diameter of the small-diameter part 71*a* and supports the inner rotor 70. A pair of sidewalls 71*c*, which is parallel to a plane perpendicular to the axial direction and faces the outsides in the axial direction, is formed between the small-diameter parts 71*a* and the large-diameter part 71*b* on opposite sides of the large-diameter part 71*b*.

Further, a cylindrical bush 79, which forms a sliding bearing together with the outer peripheral surface of the large-diameter part 71*b* of the shaft 71, is press-fitted onto the inner peripheral surface of a through hole 70*b* of the inner rotor 70. Accordingly, the inner rotor 70 is rotatably supported by the shaft 71.

That is, the shaft 71 is inserted into the through hole 70*b* interposing the bush 79 such that the small-diameter parts 71*a* protrude from opposite sides of the inner rotor 70. Further, the small-diameter parts 71*a* are press-fitted to the holes 67*a*2 and 68*a*2 of the pump housings 67 and 68 so that the inner rotor 70 is rotatably supported.

In contrast, for example, when the shaft 71 and the inner rotor 70 are formed to be integrally rotatable, the inner rotor 70 and the shaft 71 are rotatably supported with respect to the pump housings 67 and 68. Accordingly, it is necessary to provide sliding bearings such as bushes at two locations on opposite ends of the shaft 71.

On the other hand, according to this embodiment, only the inner rotor 70 is rotatably supported with respect to the shaft 71 press-fitted to the pump housings 67 and 68. Therefore, only one bush 79 forming a sliding bearing can be provided to the inner rotor 70. As a result, it is possible to simplify the structure and to reduce manufacturing cost.

In addition, the sidewalls 71*c* of the shaft 71 come in contact with the inner surfaces 67*a*1 and 68*a*1 of the pump housings 67 and 68, and the large-diameter part 71*b* of the shaft 71 is interposed between the pump housings 67 and 68. Since the large-diameter part 71*b* of the shaft 71 is interposed between the pump housings 67 and 68 so as to come in contact with the sidewalls 71*c* as described above, a predetermined distance is defined between the pump housings 67 and 68. Meanwhile, for example, a distance C between the pump housings 67 and 68 is set to be about 20 to 100 μm larger than the thickness D of the rotor part 66 and the inner rotor 70 in the axial direction, so that a clearance of about 10 to 50 μm can be ensured on opposite sides of the rotor part 66 and the inner rotor 70.

According to this embodiment, a predetermined distance is defined between the pump housings 67 and 68 by the sidewalls 11*c* formed on the shaft 71. For this reason, clearances between the pump housings 67 and 68 and the inner rotor 70 and the rotor part 66, which are provided between the pump housings 67 and 68, can be set to appropriate distances and be maintained. As a result, it is possible to suppress frictional wear between the pump housings 67 and 68 and the inner rotor 70 and rotor part 66, and to prevent lubricating oil, which is supplied by the internal gear pump 61, from leaking from the pump.

Further, a pair of bushes 80 is press-fitted onto the inner peripheral surface 64 of the outer rotor 62, interposing the rotor part 66 therebetween. Each of the bushes 80 has a cylindrical shape, and sliding bearings are formed between the inner peripheral surfaces of the bushes 80 and the outer peripheral surfaces of the supporting parts 67*a* and 68*a* of the pump housings 67 and 68. The outer rotor 62 is supported by the sliding bearings to be rotated relative to the pump housings 67 and 68.

In this case, since it is possible to simplify the structure in which the outer rotor 62 is supported by the pump housings 67 and 68, it is possible to reduce the manufacturing cost of the internal gear pump 61.

Figure 8:
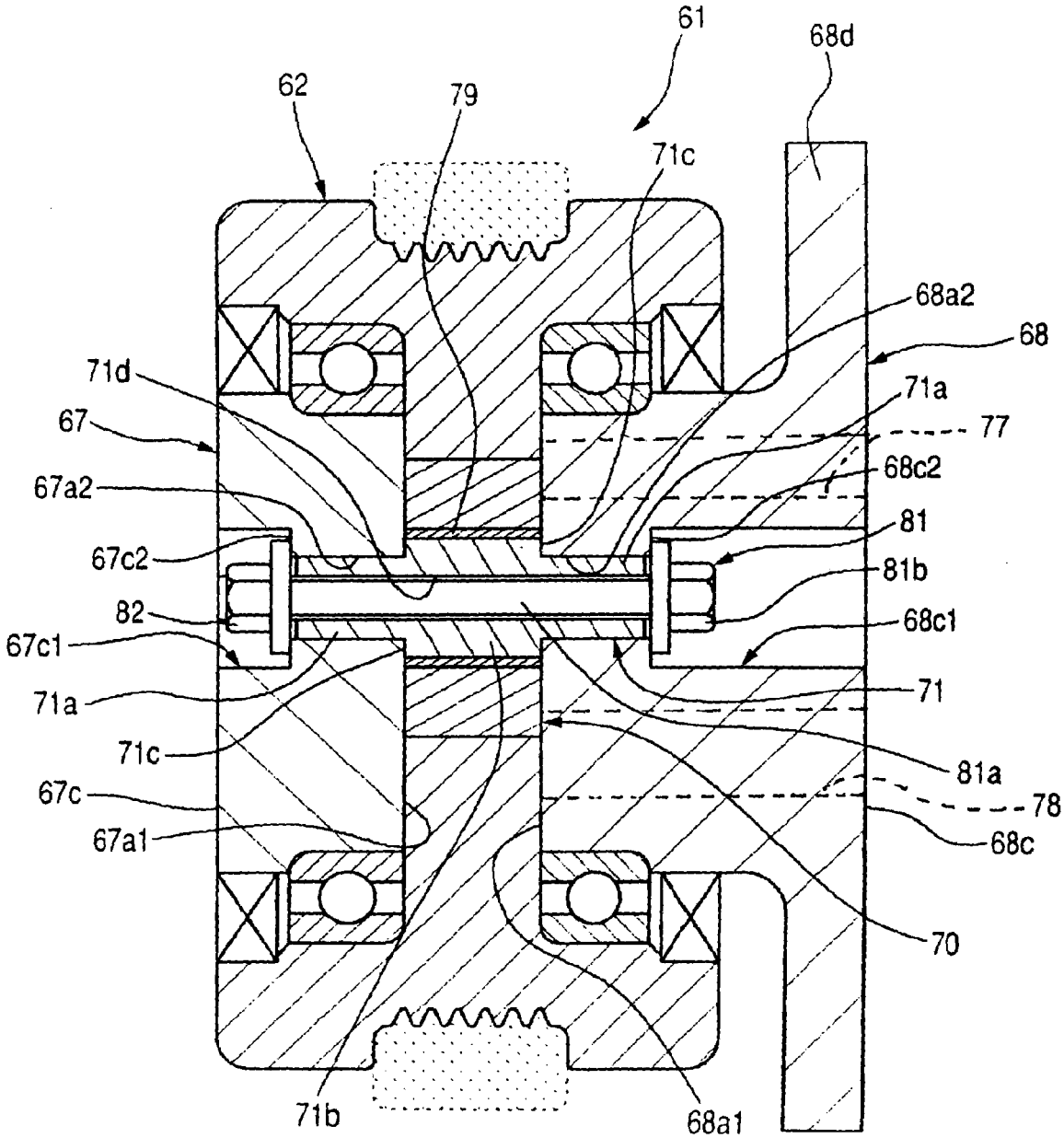
FIG. 8 is a cross-sectional view of an internal gear pump 61 according to a sixth embodiment of the invention.

FIG. 8 is a cross-sectional view of an internal gear pump 61 according to a sixth embodiment of the invention. According to this embodiment, holes 67*a*2 and 68*a*2 are formed to pass through the pump housings 67 and 68 in the axial direction. Further, a pair of sidewalls 71*c*, which defines a distance between the pump housings 67 and 68 in the axial direction, is formed on the outer peripheral surface of a shaft 71. Furthermore, a though hole 71*d* is formed to pass through the shaft in the axial direction of the shaft. The pump housings 67 and 68 are fixed to each other by a bolt 81 inserted into the through hole 71*d* and a nut 82 into which the bolt 81 is screwed.

In FIG. 8, small-diameter parts 71*a* of the shaft 71 are press-fitted into the holes 67*a*2 and 68*a*2 of the pump housings 67 and 68 so that the sidewalls 71*c* come in contact with inner surfaces 67*a*1 and 68*a*1 of the pump housings 67 and 68. The through hole 71*d* is formed in the shaft 71 to pass through the shaft in the axial direction as described above, and a shaft part 81*a* of the bolt 81 is inserted into the through hole. Counterbores 67*c*1 and 68*c*1 in which the nut 82 and a head 81*b* of the bolt 81 are received are formed in the outer surfaces 67*c* and 68*c* of the pump housings 67 and 68. Further, the shaft 71 has a length so that a distance between the ends of the small-diameter parts 71*a* of the shaft 71 is slightly shorter than a distance between bottoms 67*c*2 and 68*c*2 of the counterbores 67*c*1 and 68*c*1.

Accordingly, by fastening the bolt 81 and the nut 82 which are inserted into the through hole 71*d* of the shaft 71, the first pump housing 67 is interposed between the nut 82 and the sidewall 71*c* shown on the right side of FIG. 8. Further, the second pump housing 68 is interposed between the head 81*b* of the bolt 81 and the sidewall 71*c* shown on the left side of FIG. 8.

Accordingly, since the pump housings 67 and 68 and the shaft 71 are fixed to each other by the bolt 81 and the nut 82, the outer rotor 62 and the inner rotor 70 are reliably supported by the pump housings 67 and 68.

Further, since a pair of sidewalls 71*c* is formed in the shaft 71 like in the fifth embodiment, it is possible to define a predetermined distance between the pump housings 67 and 68 in the axial direction of the housing.

The inner rotor 70 is rotatably supported by the large-diameter part 71*b* of the shaft 71 with the bush 79 like in the second embodiment. Further, since the pair of ball bearings 69 is provided between the pump housings 67 and 68 like in the first embodiment, the outer rotor 62 is freely rotated relative to the pump housings 67 and 68.

The internal gear pump 61 having the above-mentioned structure is fixed to an engine by a flange part 68*d*, which is formed at the second pump housing 68 and extends to the outside in a radial direction thereof.

According to the internal gear pump 61 of this embodiment, since the pump housings 67 and 68 and the shaft 71 are fixed integrally to each other by the bolt 81 and the nut 82, it is not necessary to provide the flange parts 67*b* and 68*b* for fixing the pump housings 67 and 68 to each other in the housings as in the fourth and fifth embodiments. As a result, it is possible to further reduce the size of the internal gear pump in the radial and axial directions thereof and to further reduce the manufacturing cost of the internal gear pump 61.

According to this embodiment, the inlet 77 and the outlet 78 are formed in the second pump housing 68. However, one of the inlet and the outlet, or both of the inlet and the outlet may be formed in the first pump housing 67.

Figure 9:
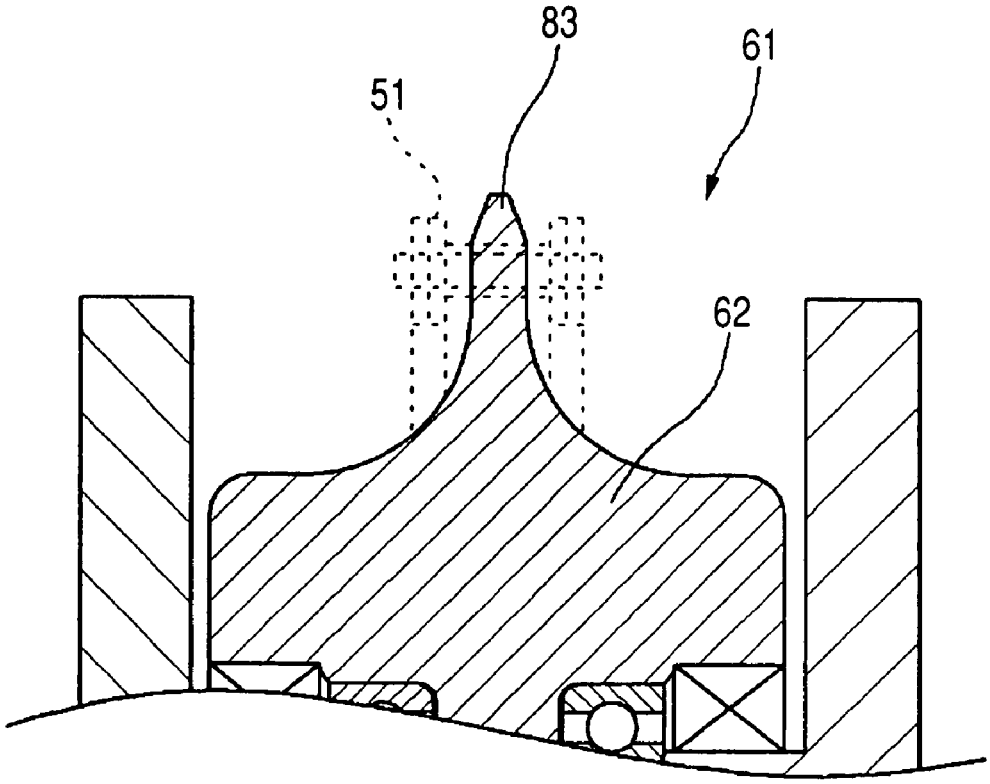
FIG. 9 is a cross-sectional view partially showing an example of an outer rotor that functions as a sprocket.

In addition, according to this embodiment, the wavy groove 63 on which the belt 50 is wound is formed on the outer peripheral surface of the outer rotor 62. However, for example, as shown in FIG. 9, a plurality of teeth 83, which is engaged with a roller chain 51 used as an endless rotation member may be formed on the outer peripheral surface of the outer rotor 62 so that the outer rotor 62 functions as a sprocket. Accordingly, the outer rotor 62 may be rotatably driven by the rotor chain 51.

The internal gear pump of the invention is not limited to the above-mentioned embodiments. For example, in the above-described embodiments, the invention has been exemplified to a trochoid pump, that is, a kind of the internal gear pump. However, for example, other internal gear pumps such as involute, parachoid, and hypocycloid internal gear pumps may be applied to an internal gear pump.

What is claimed is:

1. An internal gear pump comprising:

a rotor member comprising:

an outer rotor provided with inner teeth to which a torque supplied from a driving device is transmittable; and an inner rotor provided with outer teeth engageable with the inner teeth of the outer rotor such that the inner rotor is driven by a rotation of the outer rotor;

a pair of housings provided on opposite sides of the rotor member for supporting the rotor member; and at least one rolling bearing provided between at least one of the pair of housings and the rotor member, wherein a through hole is formed in the inner rotor such that the through hole coincides with the rotation axis of the inner rotor, wherein a shaft is rotatably inserted into the through hole such that the shaft protrudes from opposite surfaces of the inner rotor, wherein opposite ends of the shaft are fixed to the pair of housings such that the shaft rotatably supports the inner rotor, wherein the shaft comprises a pair of sidewalls for contacting the pair of housings such that a distance is defined between the pair of housings, wherein said at least one rolling bearing forms around an outer peripheral surface of a cylindrical supporting part of at least one of said pair of housings, said cylindrical supporting part supporting said rotor member, wherein said outer rotor comprises a rotor part, said rotor part comprising a pair of cylindrical parts extending from opposite edges of said rotor part in an axial direction, wherein said at least one rolling bearing is provided between inner peripheral surfaces of said pair of cylindrical parts and at least one of said pair of housings, and wherein at least one seal member is formed on an outside of said at least one rolling bearing in the axial direction and seals clearances between said cylindrical parts and said outer peripheral surface of said cylindrical supporting part.

2. The internal gear pump according to claim 1, wherein the driving device includes a motor rotor disposed on an outer peripheral side of the outer rotor for driving the rotor member by electric power.

3. The internal gear pump according to claim 2, wherein an outer peripheral surface of the outer rotor comprises a magnetic member.

4. The internal gear pump according to claim 1, wherein the rolling bearing is provided between only one of the pair of housings and the rotor member.

5. The internal gear pump according to claim 1, wherein said at least one rolling bearing comprises:

an outer ring for fitting on said inner peripheral surfaces of said pair of cylindrical parts; and an inner ring for fitting around said outer peripheral surface of said cylindrical supporting part, and wherein said rotor member is rotatably supported about an axis of said cylindrical supporting part.

6. The internal gear pump according to claim 1, wherein said shaft has a diameter that is smaller than a diameter of said through hole.

7. The internal gear pump according to claim 1, wherein an outer portion of at least one of said pair of housings comprises a flange portion that extends radially outwardly in the axial direction from an outer edge of said cylindrical supporting part, and wherein said flange portion includes an outer edge that is disposed further from said shaft than an outer edge of said outer rotor.

* * * * *